US008684347B2

(12) United States Patent
Ito et al.

(10) Patent No.: US 8,684,347 B2
(45) Date of Patent: Apr. 1, 2014

(54) SHEET AMOUNT INDICATOR AND IMAGE FORMING APPARATUS WITH AMPLIFYING MECHANISM

(71) Applicants: Shigeyuki Ito, Aichi (JP); Yoshihide Sugiyama, Aichi (JP)

(72) Inventors: Shigeyuki Ito, Aichi (JP); Yoshihide Sugiyama, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/716,506

(22) Filed: Dec. 17, 2012

(65) Prior Publication Data

US 2013/0161899 A1 Jun. 27, 2013

(30) Foreign Application Priority Data

Dec. 21, 2011 (JP) ..... 2011-279667

(51) Int. Cl.
*B65H 1/26* (2006.01)

(52) U.S. Cl.
USPC ..... 271/157; 399/81

(58) Field of Classification Search
USPC ..... 271/147, 157; 399/81
See application file for complete search history.

(56) References Cited

U.S. PATENT DOCUMENTS

| | | | | |
|---|---|---|---|---|
| 6,869,071 | B2 * | 3/2005 | Amamoto et al. | 271/171 |
| 7,784,781 | B2 * | 8/2010 | Asada | 271/145 |
| 8,393,613 | B2 * | 3/2013 | Chen | 271/145 |

FOREIGN PATENT DOCUMENTS

| | | |
|---|---|---|
| JP | H06-271141 | 9/1994 |
| JP | 2008-184246 | 8/2008 |

* cited by examiner

*Primary Examiner* — Gerald McClain
(74) *Attorney, Agent, or Firm* — Harness, Dickey & Pierce, P.L.C.

(57) ABSTRACT

Example embodiments relate to a sheet amount indicator for use in a sheet-feeding tray. The sheet-feeding tray includes a sheet stacking part having a base plate where sheets are stacked, and the base plate is configured to rise up for feeding of a topmost sheet stacked. The sheet amount indicator includes a viewing part disposed on an outer surface of the sheet stacking part, an indicator member configured to move as seen through the viewing part, a cooperative mechanism configured to move in accordance with a vertical movement of the base plate, and an amplifying mechanism disposed outside the sheet stacking part and connected to the cooperative mechanism so as to amplify the movement of the cooperative mechanism to transmit the amplified movement to the indicator member.

19 Claims, 12 Drawing Sheets

Related-Art

Related-Art

Related-Art

SHEET AMOUNT INDICATOR AND IMAGE FORMING APPARATUS WITH AMPLIFYING MECHANISM

BACKGROUND OF THE INVENTION

1. Field of the Invention

The disclosure discussed herein generally relates to a sheet amount indicator applicable to a sheet-feeding tray of an image forming apparatus, and an image forming apparatus having such a sheet amount indicator.

2. Description of the Related Art

In image forming apparatuses such as copiers, printers, and the like, sheets of paper are generally stored in a stacked fashion in a sheet-feeding tray serving as a paper container. The sheets of paper stored in the sheet-feeding tray are cut in predetermined dimensions and thus have a predetermined size. As illustrated in FIG. 12, such a sheet-feeding tray (101) may be disposed at a lower part of an image forming apparatus 100. The sheet-feeding tray 101 includes a base plate 102 movable in a vertical direction (i.e., an up-down direction), such that sheets of paper (hereinafter simply called "sheets") 103 are set in a stacked fashion on the base plate 102. The base plate 102 is upwardly pressed by a spring 104 toward an upper side so as to allow a top sheet 103 to reach a not-illustrated pickup roller. The sheets are sequentially fed from the top sheet 103 into an image forming part of a main body of the image forming apparatus 100, thereby forming a desired image on each of the sheets. When the amount of sheets on the sheet-feeding tray is reduced and a small amount of sheets stacked on the sheet-feeding tray, a user may need to physically draw out the sheet-feeding tray from the main body of the image forming apparatus 100 in order to add or supply new sheets to the sheet-feeding tray in a stacked fashion.

The sheet-feeding tray generally includes a sheet amount indicator configured to indicate presence or absence of sheets, and an amount of sheets. It is possible for a user to check the amount of sheets by directly observing the sheets stacked on the tray while drawing out the sheet-feeding tray; however, in that case, the user may need to draw out the sheet-feeding tray every time the user desires to check the amount of sheets. Hence, printing tasks may be interrupted every time the user wishes to check the amount of sheets, which may degrade printing efficiencies. Moreover, when the image forming apparatus has suddenly stopped due to running out of sheets while performing a large amount of printing, it may be difficult to supply new sheets to the sheet-feeding tray promptly. Accordingly, the user generally supplies sheets to the sheet-feeding tray in advance while monitoring the sheet amount indicator from time to time in order to supply sheets to the sheet-feeding tray and restart the printing tasks promptly.

There are two types of the sheet amount indicator; a sensor type indicator and a mechanical type indicator. The sensor type sheet amount indicator is configured to detect an amount of sheets by a sensor and indicate the detected amount, whereas the mechanical type sheet amount indicator is configured to mechanically detect the amount of sheets and indicate the detected amount. Since the sensor type sheet amount indicator is expensive, the mechanical type sheet amount indicator is widely used. An example of the mechanical type sheet amount indicator is disclosed in Japanese Laid-open Patent Publication No. 2008-184246 (hereinafter referred to as "Patent Document 1"). In this example, the mechanical type sheet amount indicator 110 may be disposed on a lateral side of the sheet-feeding tray 101 as illustrated in FIG. 13.

The mechanical type sheet amount indicator 110 illustrated in FIG. 13 includes a first arm 112, one end of the first arm 112 being supported by a shaft 111 coaxial with a shaft 102*a* of a base plate 102, the other end of the first arm 112 being connected to a front end of the base plate 102; and a second arm 114 rotatable around a shaft 113 disposed on a lateral plate 101*a* of the sheet-feeding tray 101. One end of the second arm 114 includes an elongated slot 114*a* into which a pin 112*a* of the first arm 112 is inserted. The other end of the second arm 114 extends toward a front side of the sheet-feeding tray 101 in a paper-feeding direction. A projected indicator 114*b* formed on the other end of the second arm 114 is disposed inside a viewing part 120*a* formed in a front cover 120 of the sheet-feeding tray 101 as illustrated in FIG. 14.

When the sheets are loaded in full on the sheet-feeding tray 101, and the base plate 102 is forced to a lowermost position due to the weight of the loaded sheets as illustrated in FIG. 14, a tip of the first arm 112 is located at a lowermost position, and the indicator 114*b* of the second arm 114 is located at an uppermost position. When the loaded sheets run out, the tip 112*b* of the first arm 112 moves up to an uppermost position while the indicator 114*b* moves down to a lowermost position.

Further, a sheet amount indicator disclosed in Japanese Patent Application Laid-Open Publication No. 6-271141 (hereinafter referred to as "Patent Document 2") includes a base plate, and a projection part formed on a front end of the base plate. The projection part formed on the front end of the base plate is configured to be engaged with a projection part of a rotatable display member arranged on a front cover of the sheet-feeding tray. In this configuration, the amount of sheets may be indicated when the display member is rotated according to movement of the base plate in a vertical (up-down) direction.

RELATED ART DOCUMENT

Patent Document

Patent Document 1: Japanese Laid-open Patent Publication No. 2008-184246

Patent Document 2: Japanese Patent Application Laid-Open Publication No. 6-271141

In the mechanical type sheet amount indicator disclosed in Patent Document 1, the first lever and the second lever (i.e., the first and second arms) are disposed on the lateral side of the sheet-feeding tray. Hence, the image forming apparatus may be increased in size according to an increase in the size of the sheet-feeding tray due to a space required for disposing the first and the second levers. Further, flexibility in disposing paper-feeding operating drivers, such as a motor or gears, may be restricted due to the first and the second levers disposed on the lateral side of the sheet-feeding tray. This may further increase the size of the image forming apparatus.

The mechanical type sheet amount indicator disclosed in Patent Document 2 is not disposed on the lateral side but on the front side. However, a rotational amount of the sheet amount indicator is small between when the sheets are loaded in full (in a full load condition) and when the amount of sheets is small (in a low load condition).

SUMMARY OF THE INVENTION

Accordingly, it is an object of the invention to provide a sheet amount indicator, and an image forming apparatus having the sheet amount indicator capable of reducing in size a main body of the image forming apparatus, and improving the viewability of the sheet amount indicator by effectively disposing the sheet amount indicator inside the image forming apparatus, which may substantially eliminate one or more problems caused by the limitations and disadvantages of the related art.

According to one embodiment, there is provided a sheet amount indicator for use in a sheet-feeding tray. In the sheet amount indicator, the sheet-feeding tray includes a sheet stacking part having a base plate where sheets are stacked, and the base plate is configured to rise up for feeding of a topmost sheet stacked. The sheet amount indicator includes a viewing part disposed on an outer surface of the sheet stacking part; an indicator member configured to move as seen through the viewing part; a cooperative mechanism configured to move in accordance with a vertical movement of the base plate; and an amplifying mechanism disposed outside the sheet stacking part and connected to the cooperative mechanism so as to amplify the movement of the cooperative mechanism to transmit the amplified movement to the indicator member.

Additional objects and advantages of the embodiments will be set forth in part in the description which follows, and in part will be obvious from the description, or may be learned by practice of the invention.

It is to be understood that both the foregoing general description and the following detailed description are exemplary and explanatory only and are not restrictive of the invention as claimed.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

Preferred embodiments are illustrated below, with reference to the accompanying drawings.

Note that in the following description, a "sheet-feeding tray" is removably attached to a main body of the image forming apparatus; however, a user is not required to remove the sheet-feeding tray in order to supply or add new sheets. Further, a "paper-feeding cassette" is removably attached to the main body of the image forming apparatus. Note that in the following description, a "paper-feeding cassette" is removably attached to a main body of the apparatus, and a user is required to remove the paper-feeding cassette in order to supply or add new sheets.

The sheet amount indicator according to embodiments described below may be applicable either to the paper-feeding cassette or the sheet-feeding tray; however, the sheet amount indicator applied to the sheet-feeding tray is illustrated as an example in the description of the embodiments.

Figure 1:
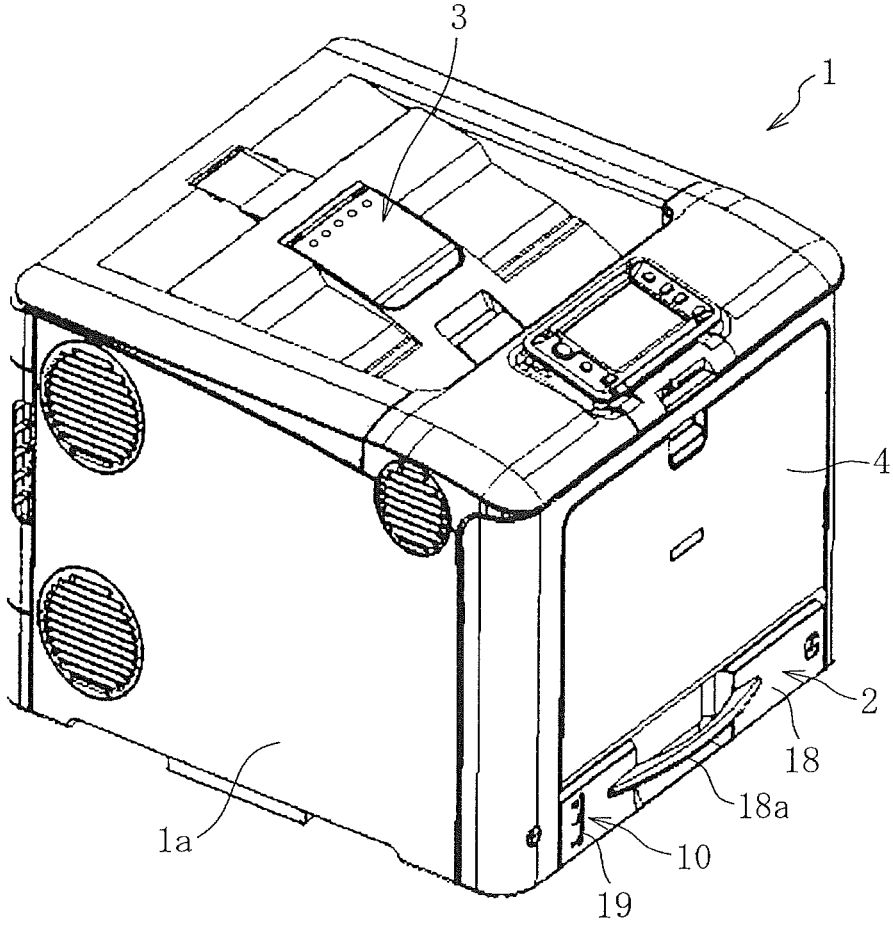
FIG. 1 is a perspective diagram illustrating an image forming apparatus having a sheet amount indicator according to an embodiment.

FIG. 1 is a perspective diagram illustrating an image forming apparatus 1 having a sheet amount indicator 10 according to an embodiment. The image forming apparatus 1 includes a main body 1*a*, and a sheet-feeding tray 2 disposed at a lower part of the main body 1*a*. The sheet-feeding tray 2 may be drawn forward (toward a front side of the sheet-feeding tray) in a horizontal direction. A paper-receiving tray 3 is disposed at an upper part of the main body 1*a*.

In the image forming apparatus 1 having the above configuration, a user draws forward the sheet-feeding tray 2 toward the front side of the sheet-feeding tray 2 in a horizontal direction, places sheets of paper in a stacked fashion in the sheet stacking part inside the sheet-feeding tray 2, and returns the sheet-feeding tray 2 back to the original position so as to initiating a printing task. Each of the sheets inside the sheet-feeding tray 2 is designed to pass through a sheet transferring path of the main body 1*a* of the image forming apparatus 1, to be transferred to an image forming part where an image is formed on the transferred sheet, and then to be discharged onto the paper-receiving tray 3 after having the image formed on the sheet. A front cover 4 for an internal check is disposed at a front side of the main body 1*a* and at an upper part of the sheet-feeding tray 2. The front cover 4 may be disposed in this fashion so as to open the cover 4 to handle sheet jamming when the sheet jamming has occurred in the sheet transferring path.

Figure 2:
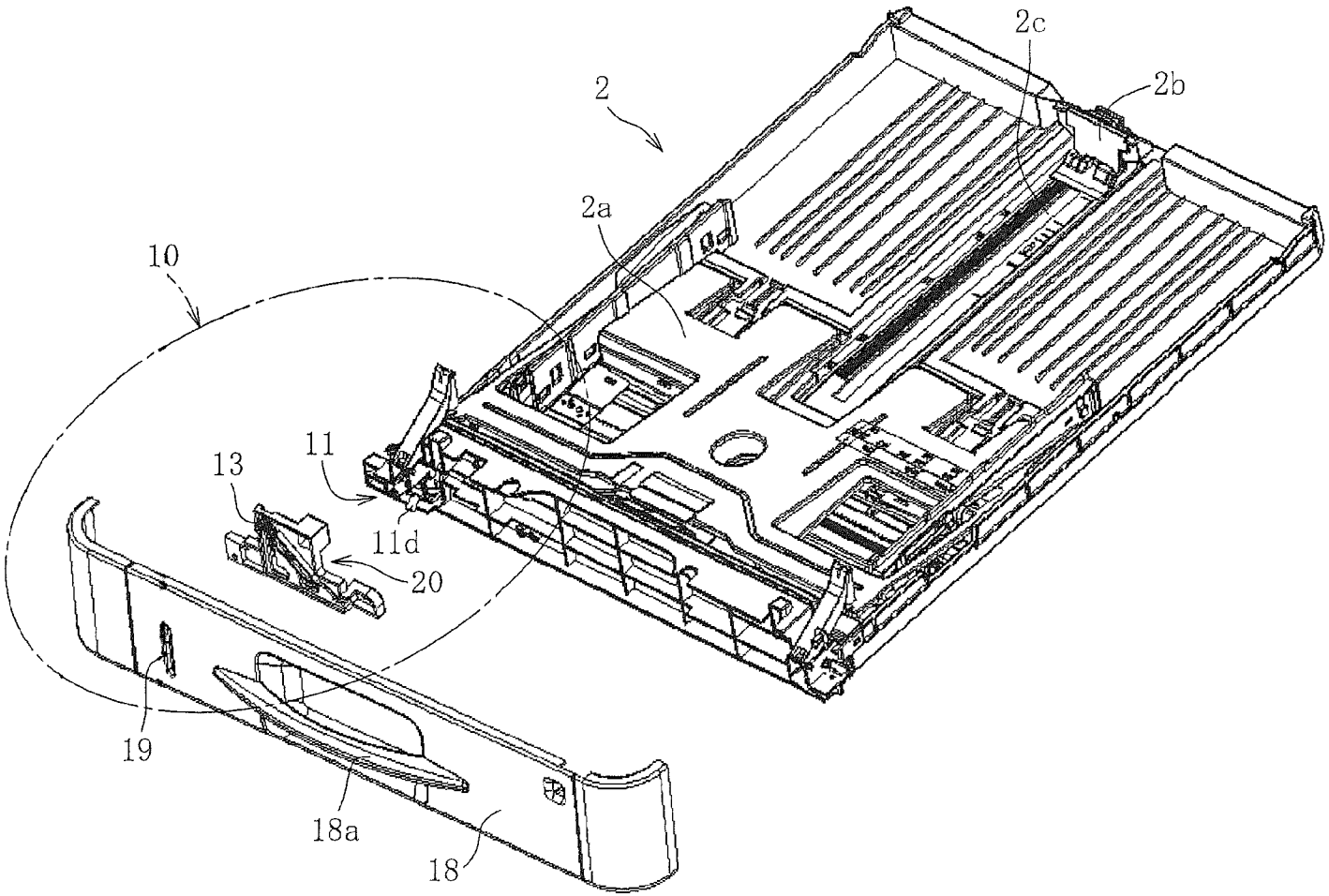
FIG. 2 is an exploded perspective diagram illustrating a sheet-feeding tray.

As illustrated in FIG. 2, the sheet-feeding tray 2 has a box-shape. In the sheet-feeding tray 2, the base plate 2*a* configured to be movable in a vertical (up-down) direction is disposed at a front side of a bottom face of the sheet-feeding tray 2, and sheets of paper are stored in a stacked fashion on the base plate 2*a*. A locating stopper 2*b* configured to be slidable in a depth (front-rear) direction is disposed at a rear side of the sheet-feeding tray 2. The locating stopper 2*b* is configured to regulate positional shifts of the sheets stored on the sheet-feeding tray 2 in the depth (front-rear) direction.

The locating stopper 2*b* slides along a guide groove 2*c* in the depth (front-rear) direction, and is locked when the sheets on the sheet-feeding tray 2 are aligned by bringing the sheets in contact with the locating stopper 2*b*.

Figure 5:
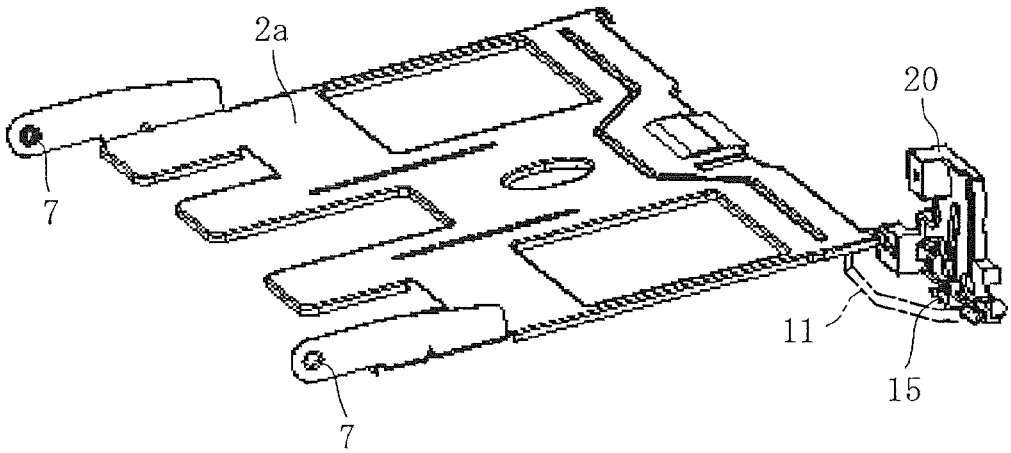
FIG. 5 is a perspective diagram illustrating abase plate and a plate member of the sheet stacking part.

The base plate 2*a* is swingably supported in a vertical (an up-down) direction around a shaft 2*d* that is disposed in a middle of a front-rear direction of the sheet-feeding tray 2. As illustrated in FIG. 5, respective holes 7 through which the shaft 2*d* is passed are formed in left and right sides of the base plate 2*a*. A not-illustrated spring is disposed on a bottom face of the base plate 2*a*, such that the base plate 2*a* is constantly urged by the spring in an upper direction. A paper-feeding mechanism such as a pickup roller or the like is disposed at an upper-front part of the sheet-feeding tray 2, such that the sheets are sequentially transferred from a top one of the sheets, pass through the sheet transferring path, and reach an image forming part disposed at an upper part of the main body 1*a* inside the image forming apparatus 1.

A first arm 11 is disposed at a front-left corner near an outer edge of the sheet-feeding tray 2 as illustrated in FIGS. 2 to 5. The first arm 11 has a configuration illustrated in FIG. 6. That is, the first arm 11 is configured to serve as an cooperative mechanism that communicates a vertical movement of the base plate 2*a* with later-described second arm 12 and third arm 13, and to further serve as part of an amplifying mechanism, together with the second arm 12 and the third arm 13, of the sheet amount indicator 10 according to the embodiment. Note that the vertical movement of the base plate 2*a* may be directly communicated with the second arm 12 by forming a projection on a front end of the base plate 2*a*, and connecting the projection to the second arm 12. In such a configuration, the projection may serve as the cooperative mechanism.

Figure 3:
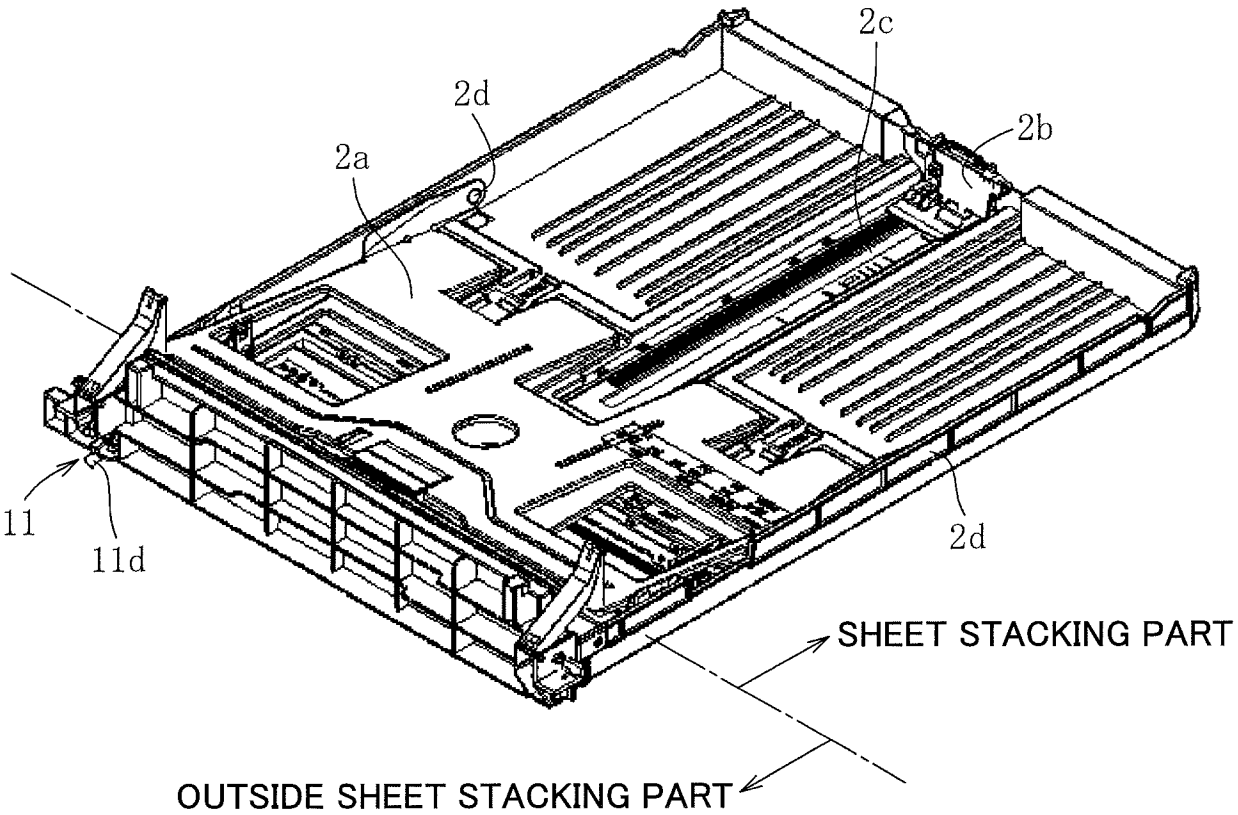
FIG. 3 is a perspective diagram illustrating a sheet stacking part.
Figure 4:
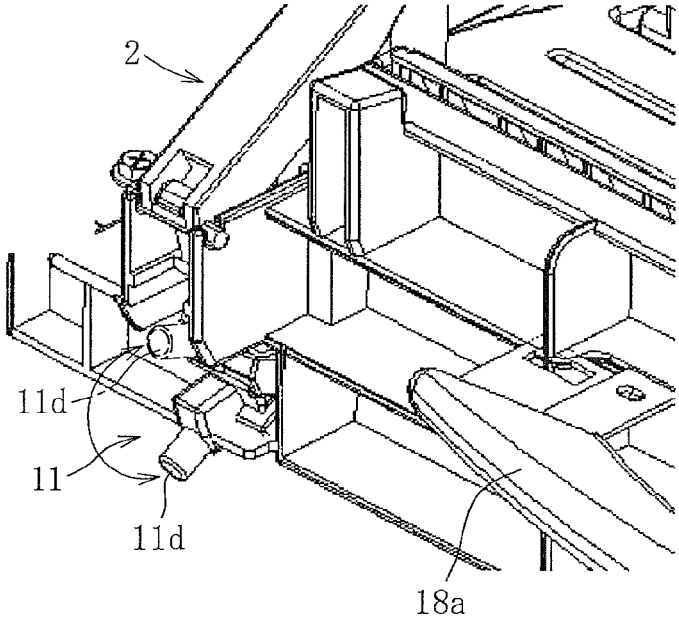
FIG. 4 is an enlarged diagram illustrating a main part of a first arm of the sheet stacking part.

As illustrated in FIG. 3, the first arm 11 is disposed at a sheet storage outside part located at a front side of the sheet stacking part. That is, the first arm 11 is, as illustrated in FIGS. 4 and 5, disposed at a front side of a corner of the base plate 2*a*, and hence, the sheet stacking part has no special restriction by having the first arm 11.

Figure 6:
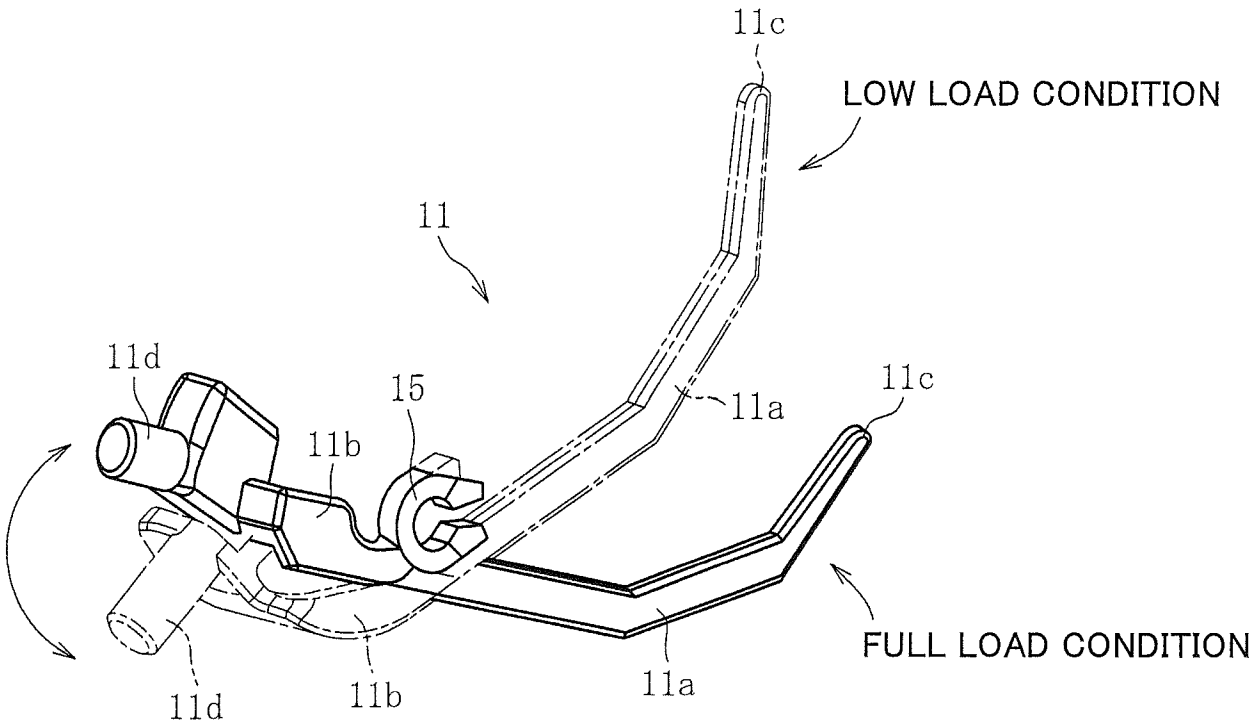
FIG. 6 is a perspective diagram illustrating a first arm member.

The first arm 11 has a middle part that is rotatable in a vertical (an up-down) direction around a fulcrum 15 disposed on the sheet-feeding tray 2 as illustrated in FIG. 6. A rear side part 11*a* of the first arm 11 located behind the fulcrum 15 is elongated to be several times as long as a front side part 11*b* of the first arm 11. The rear side part 11*a* of the first arm 11 includes two angles at respective positions to form a recess in an upper side direction. A rear end 11*c* of the rear side part 11*a* is constantly in forced contact with a right corner of a front end of the bottom face of the base plate 2*a* as illustrated in FIG. 5.

In order to allow the rear end 11*c* of the first arm 11 to be constantly in contact with the base plate 2*a* as described above, a torsion spring or the like is disposed at the fulcrum 15 of the first arm, or a weight is attached to the front side part 11*b* of the first arm 11, such that the front side part 11*b* of the first arm 11 is heavier than the rear side part 11*a* of the first arm 11. Further, a pressing part configured to lower the later-described second arm 12 or the third arm 13 in a lower direction is disposed such that the rear end 11*c* of the first arm 11 is constantly in contact with the base plate 2*a*.

Note that the contacting position of the rear end 11*c* may not be limited to the right corner of the front end of the bottom face of the base plate 2*a*. The rear end 11*c* may be in contact with a left corner of the front end of the bottom face of the base plate 2*a*, or may be in contact with any part of the base plate 2*a* insofar as the sheet-feeding tray 2 will not be specially restricted.

A front edge of the base plate 2*a* approaches the rear side part 11*a* of the first arm 11 as the base plate 2*a* approaches a lowermost position. However, as described above, since the rear side part 11*a* of the first arm 11 is bent to form a recess in an upper side direction, the front edge of the base plate 2*a* will not interfere with the rear side part 11*a* of the first arm 11. The front side part 11*b* of the first arm 11 extends forward (toward a front side of the first arm) in a relatively short length, and a short cylindrical boss part 11*d* is formed on the front end of the front side part 11*b*.

A front cover 18 having a hand grip 18*a* is configured to be attached to the front face of a main body of the sheet-feeding tray 2 with not-illustrated plural screws, as illustrated in FIG. 2. A viewing part 19 formed of an elongated slot elongated in a vertical (an up-down) direction is formed on the left hand side of the front cover 18. In this embodiment, the viewing part 19 is formed of the elongated slot elongated in the vertical (up-down) direction; however, in view of a design of the front cover 18, the viewing part 19 may be formed of an elongated slot elongated in a horizontal (left-right) direction or an arc slot.

A plate member 20 formed of a combination of the second arm 12 and the third arm 13 orthogonal to a longitudinal direction of the first arm 11 is disposed between the front cover 18 and the front end of the main body of the sheet-feeding tray 12. The plate member 20 is configured to be attached to the front end of the main body of the sheet-feeding tray 2 with three screws inserted through screw holes 20*d* to 20*f* as illustrated with broken lines in FIG. 7A. The front cover 18 is attached to the main body of the sheet-feeding tray 2 after the plate member 20 has been fixed to the main body of the sheet-feeding tray 2.

Figure 7A:
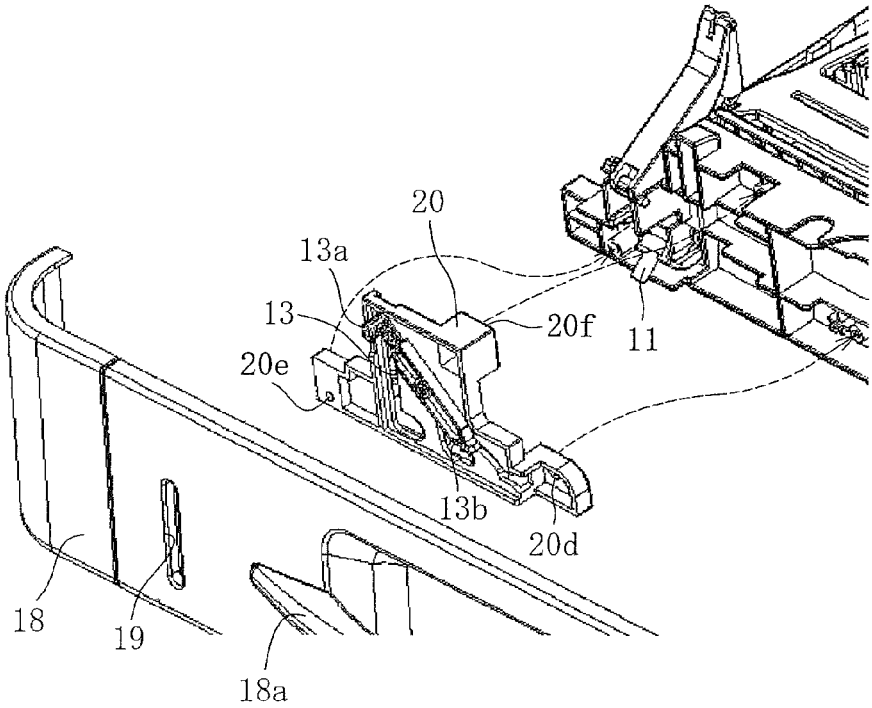
FIG. 7A is an exploded perspective diagram illustrating a main part of the sheet-feeding tray.
Figure 7B:
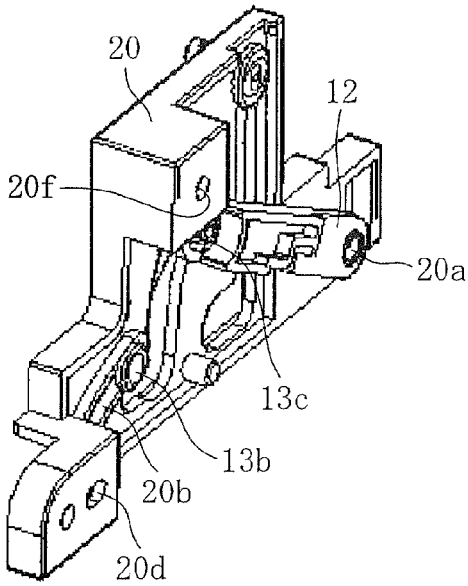
FIG. 7B is a perspective view illustrating the plate member viewing from a rear side.
Figure 8A:
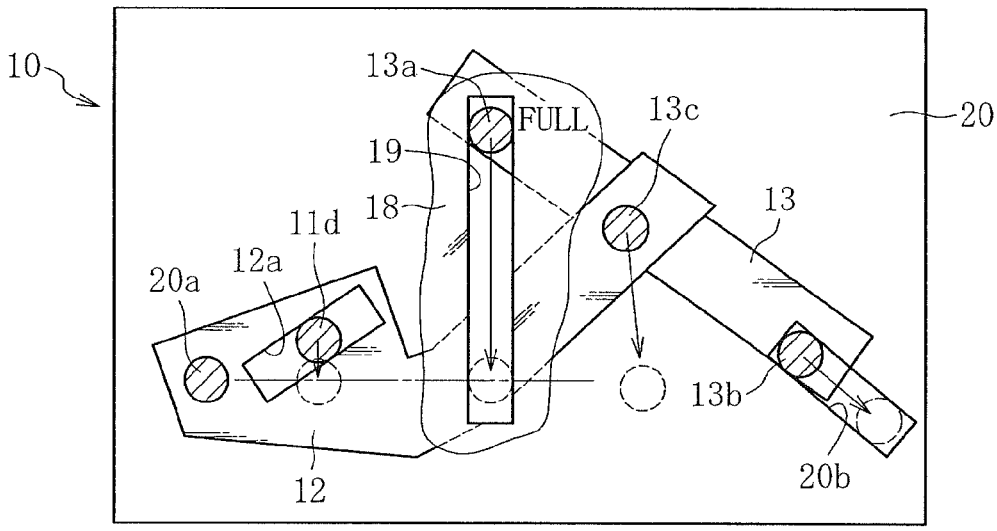
FIG. 8A is a schematic front diagram illustrating the sheet amount indicator when sheets are loaded in full (a full load condition)
Figure 8B:
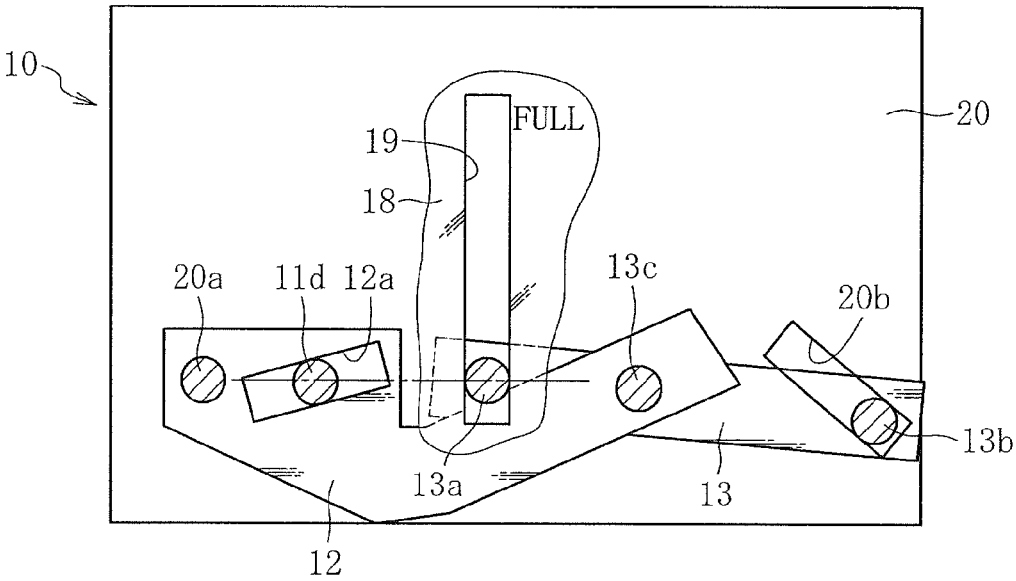
FIG. 8B is a schematic front diagram illustrating the sheet amount indicator when the amount of sheets is small (a low load condition)

The second arm 12 and the third arm 13 are disposed on a front face and a rear face of the plate member 20, respectively, such that the second arm 12 and the third arm 13 are disposed back-to-back via the plate member 20 as illustrated in FIGS. 7A and 7B. The rear face of the plate member 20 on which the second arm 12 is disposed is directed toward the main body side of the sheet-feeding tray 2. One end of the second arm 12 is rotatably supported by a fulcrum 20*a* of the plate member 20 as illustrated in FIG. 7B. A guide groove 12*a* for receiving the boss part 11*d* of the first arm 11 is formed in an area near the fulcrum 20*a* of the second arm 12 as illustrated in FIGS. 8A and 8B.

A boss part 13*a* serving as an indicator member inside the viewing part 19 is formed on one end of the third arm 13. The boss part 13*a* is slidable in a vertical (up-down) direction along the viewing part 19 with movement of the third arm 13. Further, a boss part 13*b* is formed on the other end of the third arm 13, and the boss part 13*b* is slidably disposed in a guide groove 20*b* diagonally formed in the plate member 20. A rotatable supporting part 13*c* disposed in a middle part of the third arm 13 is rotatably connected to an end of the second arm 12.

Accordingly, in this embodiment, the second arm 12 and the third arm 13 are disposed along the front cover 18 in a direction orthogonal to the first arm 11 inside the front cover 18 of the sheet-feeding tray 2. The cover 18 has a sufficient internal space in a horizontal (left-right) direction, such that the second arm 12 and the third arm 13 are arranged in a relatively desired layout together with the viewing part 19 without limitations.

Accordingly, the moving amount of the boss part 13*a* serving as the indicator member determined by the second arm 12 and the third arm 13, and the size, shape, and position of the viewing part 19 may be designed in a relatively desired manner without limitations. This may improve the design properties of the front face of the sheet-feeding tray 2. Further, the sheet stacking part is configured in a compact size by disposing the first to third arms 11 to 13 outside the sheet stacking part as illustrated in FIG. 3, which may reduce the size of the main body of the image forming apparatus.

The sheet amount indicator 10 according to the first embodiment is configured, as described above, such that the base plate 2*a* and the rear end 11*c* of the first arm 11 in contact with the base plate 2*a* are both located at their lowermost positions. On the other hand, the boss part 11*d* of the front end of the first arm 11 is located at its uppermost position, and the second arm 12 and the third arm 13 are located at rising positions as illustrated in FIG. 8A. Accordingly, the boss part 13*a* of the third arm 13 serving as an indicator member is located at its uppermost position inside the viewing part 19, indicating that the sheets are loaded in full in the sheet-feeding tray 2.

The sheets are reduced in number as printing is performed on more of the sheets. As the number of sheets is reduced, the base plate 2*a* is raised by the spring force, and the rear end 11*c* of the first arm 11 being in contact with the bottom face of the base plate 2*a* is raised as illustrated by dash-dot lines in FIG. 6. Accordingly, the boss part 11*d* of the first arm 11 is moved down to a lower side, and the second arm 12 and the third arm 13 are moved down to a lower side as illustrated in FIG. 8B. Accordingly, the boss part 13*a* of the third arm 13 serving as an indicator member is moved down to a lower side inside the viewing part 19, indicating that the amount of sheets stacked on the sheet-feeding tray 2 is small (in the low load condition).

Since the sheet amount indicator 10 includes the amplifying mechanism formed of the first arm 11, the second arm 12, and third arm 13, the moving amount of the base plate 2*a* determined in accordance with the reduction in the amount of sheets may be reflected as a moving amount of the boss part 13*a* serving as the indicator member inside the viewing part 19 by increasing the moving amount of the base plate 2*a* by the first, second, and third arms. Accordingly, viewability of the viewing part 19 may be improved.

Further, since the second arm 12 and the third arm 13 are disposed along the front cover 18 inside the front cover 18 of the sheet-feeding tray 2, it is possible to arrange the second arm 12 and the third arm 13 in a desired layout together with the viewing part 19. In addition, the moving amount of the boss part 13*a* of the third arm 13 serving as an indicator member may be set at a desired magnification by appropriately changing the respective lengths or positions of the second arm 12 and the third arm 13. Accordingly, the size, the shape, and the position of the sheet amount indicator may be changed according to the desired magnification, which may improve the design properties of the front cover 18 of the sheet stacking part.

Figure 9A:
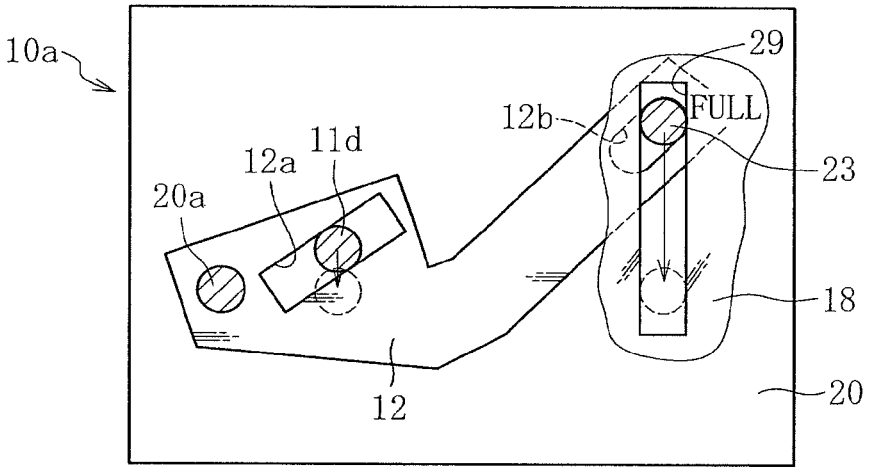
FIG. 9A is a schematic front diagram illustrating a sheet amount indicator according to a second embodiment when sheets are in a full load condition.
Figure 9B:
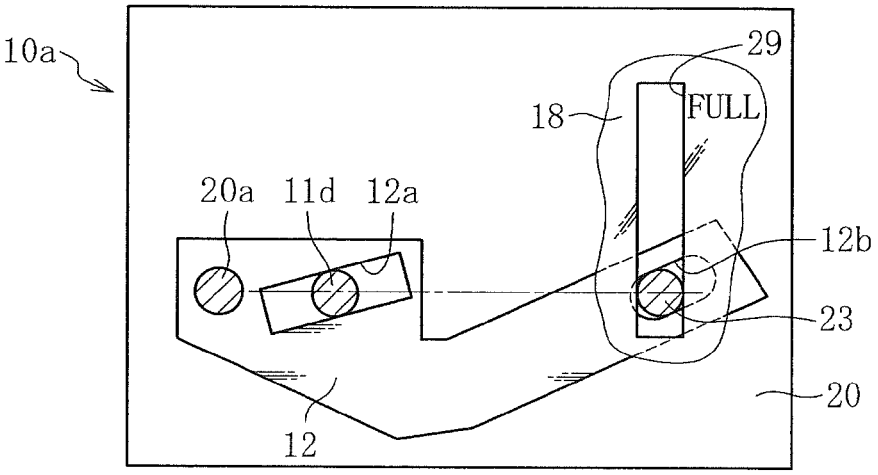
FIG. 9B is a schematic front diagram illustrating the sheet amount indicator according to the second embodiment when sheets are in a low load condition.

Next, a second embodiment is described with reference to FIGS. 9A and 9B.

A sheet amount indicator 10*a* according to the second embodiment excludes the third arm 13 that is provided in the sheet amount indicator 10 according to the first embodiment. In the sheet amount indicator 10*a* according to the second embodiment, a boss part 23 serving as an indicator member disposed at an end of the second arm 12 is configured to indicate an amount of sheets. The boss part 23 is slidably inserted in the viewing part 29 and as well as being slidably inserted in an elongated slot 12*b* formed in the front end of the second arm 12.

Since the sheet amount indicator 10*a* according to the second embodiment excludes a widening function of the third arm 13, the moving amount of the boss part 23 serving as an indicator member is reduced. Accordingly, a length of a viewing part 29 is reduced in a vertical (up-down) direction in an amount provided by the excluded third arm 13. However, in the sheet-feeding tray 2 of the image forming apparatus having a relatively small capacity to store the sheets, it may be possible to improve the viewability of the amount of sheets via the viewing part 29 having a short length in a vertical (up-down) direction.

Next, a third embodiment is described with reference to FIG. 10.

A sheet amount indicator 10*b* according to the third embodiment includes a first arm 31 and a second arm 32. The configuration of the first arm 31 is the same as the configuration of the first arm 11 in the sheet amount indicator 10 according to first embodiment. The second arm 32 has a shape having a curved part in a middle part of the second arm 32. The curved part of the second arm 32 is rotatably supported by a fulcrum 20*c* provided in the plate member 20. One end 32*a* of the second arm 32 serving as an indicator member extends inside of the viewing part 32. The other end 32*b* of the second arm 32 includes an elongated slot 32*c* into which a boss part 31*d* of the front end of the first arm 31 is slidably inserted.

In the sheet amount indicator 10*b* according to the third embodiment, a boss part 31*d* of a frond end of the first arm 31 is moved up to the uppermost position when the sheets are loaded in full (in the full load condition), and an end 32*a* of the second arm 32 serving as an indicator member is moved to the right end of the viewing part 39, which indicates that the sheets in the sheet-feeding tray 2 are in the full load condition. Note that the deflection width of the end 32*a* of the second arm 32 is changeable by changing the length of the second arm 32. Accordingly, the viewability of an amount of sheets viewable from the viewing part 39 may be improved by changing the length of the second arm 32, or the design properties of the viewing part 39 may be improved based on a desired storage capacity of the paper storage part or desired design properties of the viewing part 39.

Figure 10:
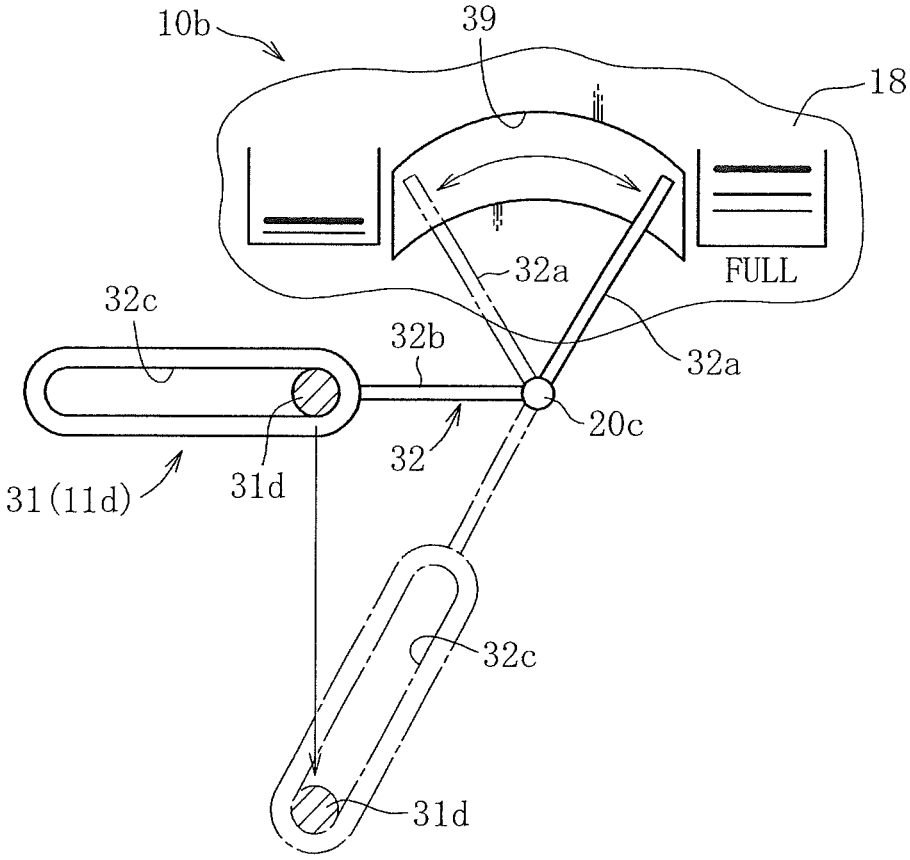
FIG. 10 is a schematic front diagram illustrating a sheet amount indicator according to a third embodiment when sheets are in a full load condition.

When the amount of sheets becomes small, the boss part 31*d* of the front end of the first arm 31 is moved down to a lower side as illustrated in dash-dot lines in FIG. 10, and the end 32*a* of the second arm 32 serving as an indicator member is moved to the left end inside the viewing part 39, indicating that the amount of sheets in the sheet-feeding tray 2 is small (in the low load condition).

Figure 11A:
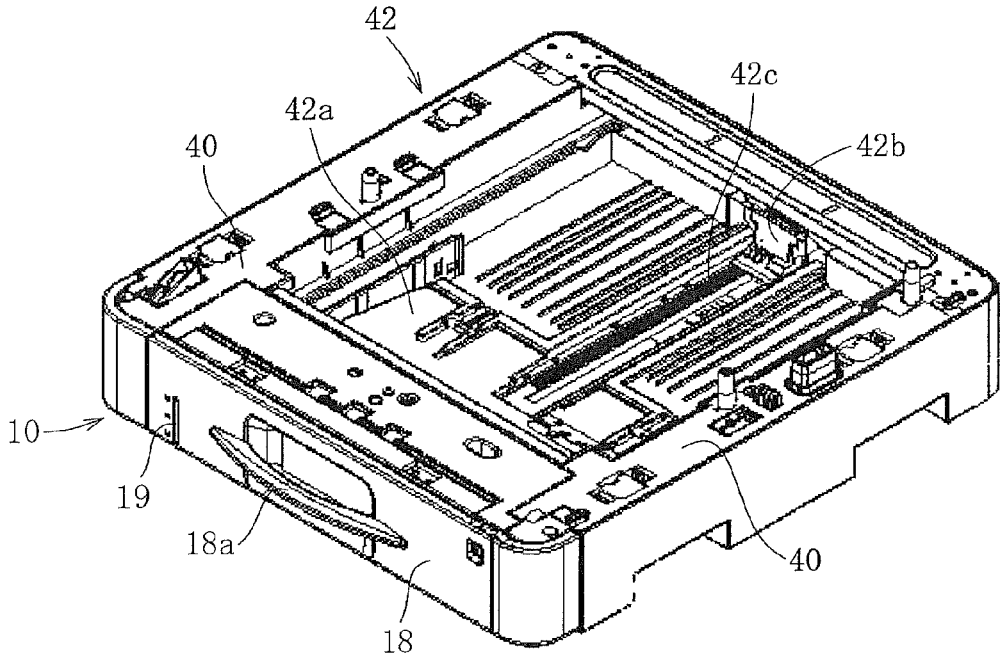
FIG. 11A is a perspective diagram illustrating an additional sheet-feeding tray having the sheet amount indicator according to the embodiments.
Figure 11B:
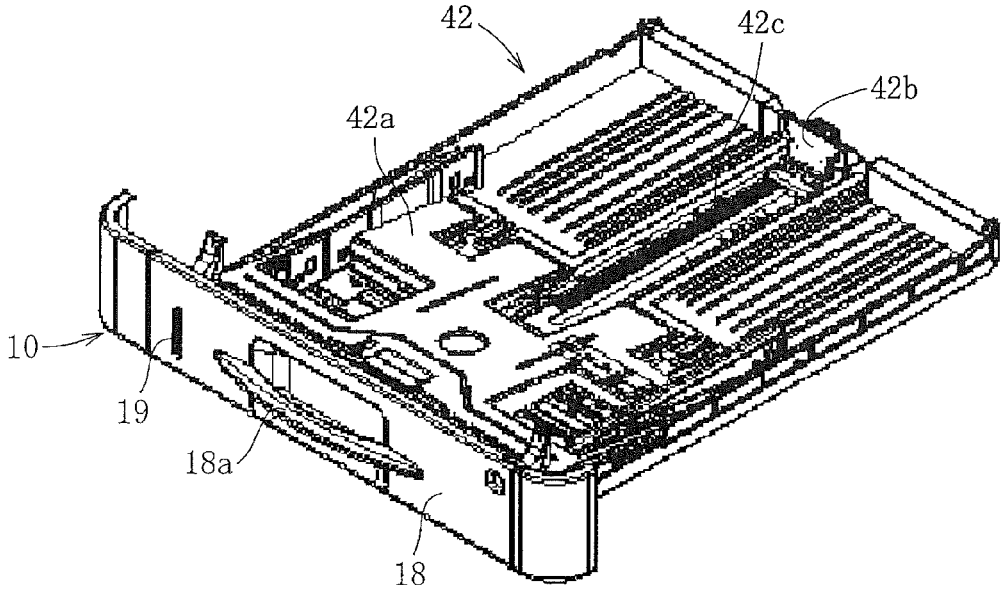
FIG. 11B is a perspective diagram illustrating the additional sheet-feeding tray illustrated in FIG. 11A from which a driver part is removed.
Figure 12:
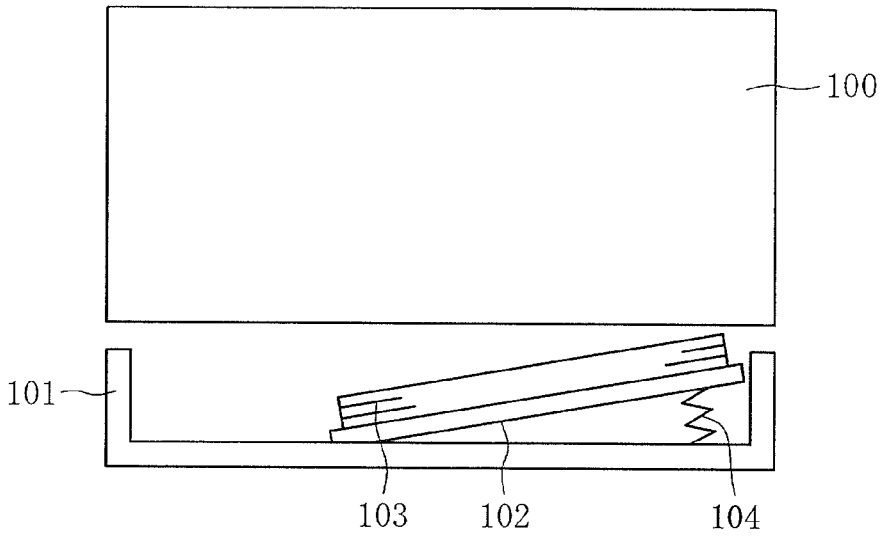
FIG. 12 is a schematic side diagram illustrating the sheet-feeding tray disposed at a lower part of a main body of a related-art image forming apparatus.
Figure 13:
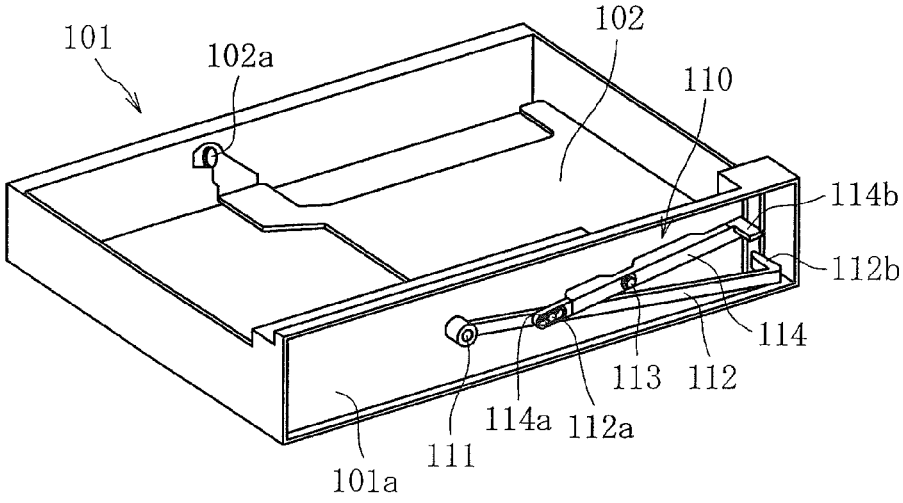
FIG. 13 is a perspective diagram illustrating a related-art sheet-feeding tray.
Figure 14:
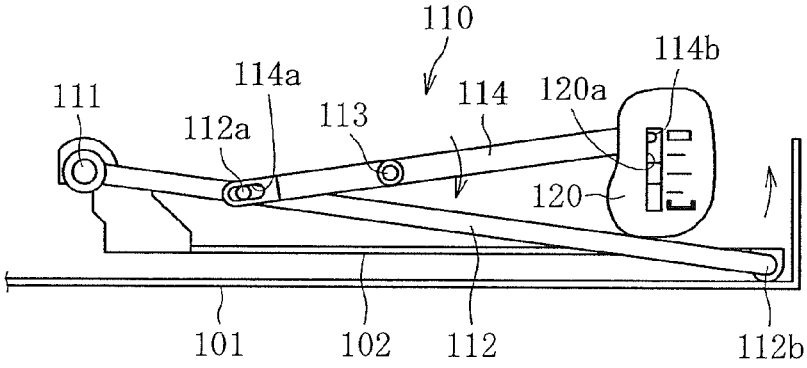
FIG. 14 is a side diagram illustrating the related-art sheet amount indicator.

The sheet amount indicator according to the embodiments may be applied to an additional tray other than the sheet-feeding tray 2. FIGS. 11A and 11B illustrate an example in which the sheet amount indicator 10 is applied to an additional tray 42. The additional tray 42 also includes abase plate 42*a*, a stopper 42*b*, a guide groove 42*c*, and a front cover 18 having a hand grip 18*a*, and the viewing part 19 is formed on the left end of the front cover 18, similar to the example illustrated in FIG. 2. Paper-feeding drivers 40 are disposed on a left side and a right side of the additional tray 42. However, the position of the sheet amount indicator 10 does not overlap the positions of the paper-feeding drivers 40. Accordingly, the additional tray 42 will not be increased in size by having the additional tray, and no interference may be imposed on flexibility in designing arrangement or layout of the paper-feeding drivers 40. FIG. 11B illustrates the additional tray 42 from which the paper-feeding drivers 40 are removed.

The embodiments of the present invention are described above; however, the invention is not limited to the above embodiments. Various changes and modification may be made to the above embodiments. For example, in the above embodiments, the viewing part 19, 29, or 39 is disposed on the front cover 18. However, the viewing part 19, 29, or 39 may be disposed on a lateral face of the main body 1*a* other than the front cover 18. In addition, in the above embodiments, the viewing part 19, 29, or 39 is applied to the sheet-feeding tray 2. However, the viewing part 19, 29, or 39 may be applied to a paper-feeding cassette, or the like. Moreover, the amplifying mechanism may be formed of three or more arms.

According to the above embodiments, since the amplifying mechanism configured to increase a moving width of the base plate of the paper storage part in the vertical (up-down) direction to transmit the increased moving width is disposed outside the paper storage part, the paper storage part does not have any special limitation. Accordingly, the flexibility in designing may be improved without increasing the size of the paper storage part. Further, the amplifying mechanism may be flexibly configured such that the moving amount of the indicator member may be increased. Accordingly, the viewability of the amount of sheets may be improved.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that various changes, substitutions, and alterations could be made hereto without departing from the spirit and scope of the invention.

This patent application is based on Japanese Priority Patent Application No. 2011-279667 filed on Dec. 21, 2011, the entire contents of which are hereby incorporated herein by reference.

What is claimed is:

1. A sheet amount indicator for use in a sheet-feeding tray, the sheet-feeding tray including a sheet stacking part having a base plate where sheets are stacked, the base plate being configured to rise up for feeding of a topmost sheet stacked, the sheet amount indicator comprising:

a viewing part disposed on an outer surface of the sheet stacking part;

an indicator member configured to move as seen through the viewing part;

a cooperative mechanism configured to move in accordance with a vertical movement of the base plate; and an amplifying mechanism disposed outside the sheet stacking part and connected to the cooperative mechanism so as to amplify the movement of the cooperative mechanism to transmit the amplified movement to the indicator member wherein the cooperative mechanism includes a first arm having a front part, a middle part and a rear part, the front part extending outside the sheet stacking part, the middle part being configured to pivot the first arm in a vertical direction around a fulcrum disposed on the sheet-feeding tray, and the rear part being in contact with the base plate, and wherein the entire front, middle, and rear parts are coplanar.

2. The sheet amount indicator as claimed in claim 1, wherein the amplifying mechanism includes a second arm disposed at a front side of the sheet stacking part such that the second arm is orthogonal to the first arm.

3. The sheet amount indicator as claimed in claim 2, wherein one end of the second arm is rotatably supported by a fulcrum.

4. The sheet amount indicator as claimed in claim 3, further comprising a guide groove for receiving a cylindrical boss part of the first arm, wherein the guide groove is formed in an area near the fulcrum of the second arm.

5. The sheet amount indicator as claimed in claim 1, wherein the rear part is located behind the fulcrum and is longer as compared to the front part.

6. The sheet amount indicator as claimed in claim 1, wherein the rear part include two angles at positions to form a recess in the rear part.

7. An image forming apparatus, comprising:

the sheet amount indicator as claimed in claim 1.

8. The sheet amount indicator as claimed in claim 1, wherein the front part of the first arm is heavier than the rear part of the first arm.

9. The sheet amount indicator as claimed in claim 1, wherein a torsion spring is provided at the fulcrum of the first arm.

10. The sheet amount indicator as claimed in claim 1, wherein the rear part of the first arm is bent to form a recess in an upper side direction.

11. The sheet amount indicator as claimed in claim 1, further comprising a cylindrical boss part formed in a front portion of the front part of the first arm.

12. The sheet amount indicator as claimed in claim 1, further comprising a front cover attached to a front side of the sheet-feeding tray.

13. The sheet amount indicator as claimed in claim 12, wherein the amplifying mechanism is between the front cover and the front side of the sheet-feeding tray.

14. The sheet amount indicator as claimed in claim 13, wherein the amplifying mechanism is configured to be attached to the front side of the sheet-feeding tray with a plurality of fastening members.

15. The sheet amount indicator as claimed in claim 1, wherein the amplifying mechanism includes a second arm disposed at a front side of the sheet stacking part such that the second arm is orthogonal to the first arm, and a third arm.

16. The sheet amount indicator as claimed in claim 15, wherein the second and third arms are formed within a plate member with the second arm being disposed on one surface of a plate member and the third arm being disposed on another surface of the plate member in a back-to-back formation.

17. The sheet amount indicator as claimed in claim 15, wherein the indicator member is formed on one end of the third arm and is slidable in a vertical direction along the viewing part with movement of the third arm.

18. The sheet amount indicator as claimed in claim 15, further comprising a boss part formed on one end of the third arm, wherein the boss part is slidably disposed in a guide groove diagonally formed in the amplifying mechanism.

19. The sheet amount indicator as claimed in claim 15, wherein the second arm and the third arm move with respect to each other.

* * * * *